US007894760B2

(12) United States Patent
Gunbe

(10) Patent No.: US 7,894,760 B2
(45) Date of Patent: Feb. 22, 2011

(54) DISPOSED TONER COLLECTING DEVICE OF IMAGE FORMING APPARATUS

(75) Inventor: Eiji Gunbe, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 84 days.

(21) Appl. No.: 12/207,464

(22) Filed: Sep. 9, 2008

(65) Prior Publication Data

US 2009/0067873 A1 Mar. 12, 2009

Related U.S. Application Data

(60) Provisional application No. 60/971,243, filed on Sep. 10, 2007.

(51) Int. Cl.
*G03G 21/10* (2006.01)

(52) U.S. Cl. ..... 399/358; 399/258

(58) Field of Classification Search ..... 399/358, 399/360, 258, 261, 99

See application file for complete search history.

(56) References Cited

U.S. PATENT DOCUMENTS

| | | | | |
|---|---|---|---|---|
| 6,085,062 | A * | 7/2000 | Mizuishi et al. | 399/358 |
| 6,266,511 | B1 * | 7/2001 | Murakami et al. | 399/358 |
| 6,937,838 | B2 * | 8/2005 | Ishii et al. | 399/358 |
| 7,127,207 | B2 * | 10/2006 | Tsurusaki | 399/359 |
| 7,437,116 | B2 * | 10/2008 | Lee | 399/360 X |
| 2005/0002708 | A1 * | 1/2005 | Jeong et al. | 399/358 |
| 2005/0220515 | A1 * | 10/2005 | Wakana | 399/358 |
| 2006/0062614 | A1 * | 3/2006 | Choi | 399/358 |
| 2008/0031657 | A1 * | 2/2008 | Okuda et al. | 399/258 |
| 2008/0118290 | A1 * | 5/2008 | Sato | 399/358 |
| 2008/0187366 | A1 * | 8/2008 | Moon et al. | 399/258 |

* cited by examiner

*Primary Examiner*—Sophia S Chen
(74) *Attorney, Agent, or Firm*—Patterson & Sheridan, LLP

(57) ABSTRACT

According to an embodiment of the invention, a sliding plate that slides in contact with an inner wall of a disposed toner duct is oscillated by using rotation of a disposed toner collection auger. As the sliding plate is oscillated, disposed toner falling and fed through the disposed toner duct is oscillated. The disposed toner adhering to the inner wall of the disposed toner duct is removed by sliding of both lateral parts of the sliding plate in contact with the inner wall.

17 Claims, 6 Drawing Sheets

DISPOSED TONER COLLECTING DEVICE OF IMAGE FORMING APPARATUS

CROSS-REFERENCE TO RELATED APPLICATION

This application is based upon and claims the benefit of priority from provisional U.S. Patent Application 60/971,243, filed on Sep. 10, 2007, the entire contents of which are incorporated herein by reference.

TECHNICAL FIELD

The present invention relates to a disposed toner collecting device that collects used disposed toner in a copy machine, printer or the like that forms an image by an electrophotographic system.

BACKGROUND

An image forming apparatus such as a copy machine or printer employs a device that causes disposed toner that is removed from a photoconductor by a cleaner, to fall down by using gravity through a collection duct integrated with the cleaner, and thus collects the disposed toner into a disposed toner box. If the collection duct is curved, a spiral member is provided in order to improve the disposed toner feeding ability in the cleaner and in the collection duct. The spiral member is formed in the shape of a coil spring by using a piano wire, stainless steel wire or the like.

However, if disposed toner is to be fed in the cleaner and in the curved collection duct by using one spiral member, the motion of the spiral member may be deteriorated. This may cause deposition of disposed toner and deterioration in maintenance capability.

Thus, it is desired that a disposed toner collecting device is developed in which clogging with disposed toner does not occur despite the use of a curved collection duct, and in which falling and feeding of disposed toner is promoted to enable secure collection of disposed toner into a disposed toner collection box.

SUMMARY

According to an aspect of the invention, a disposed toner collecting device is provided in which clogging of a collection duct with disposed toner removed from a photoconductor is prevented, thereby promoting smooth falling and feeding of disposed toner through the collection duct and thus collecting disposed toner into a disposed toner collection box.

According to an aspect of the invention, a disposed toner collecting device includes a guide that causes disposed toner discharged from a disposed toner discharge unit of an image forming unit to fall in a predetermined direction, a feeding assistance unit configured to provide oscillation to the disposed toner in the guide, a cam driven by driving of the image forming unit, a transmitting unit configured to transmit the driving of the cam to the feeding assistance unit, and a collecting unit connected to a lower end of the guide and configured to collect the disposed toner.

DETAILED DESCRIPTION

Figure 1:
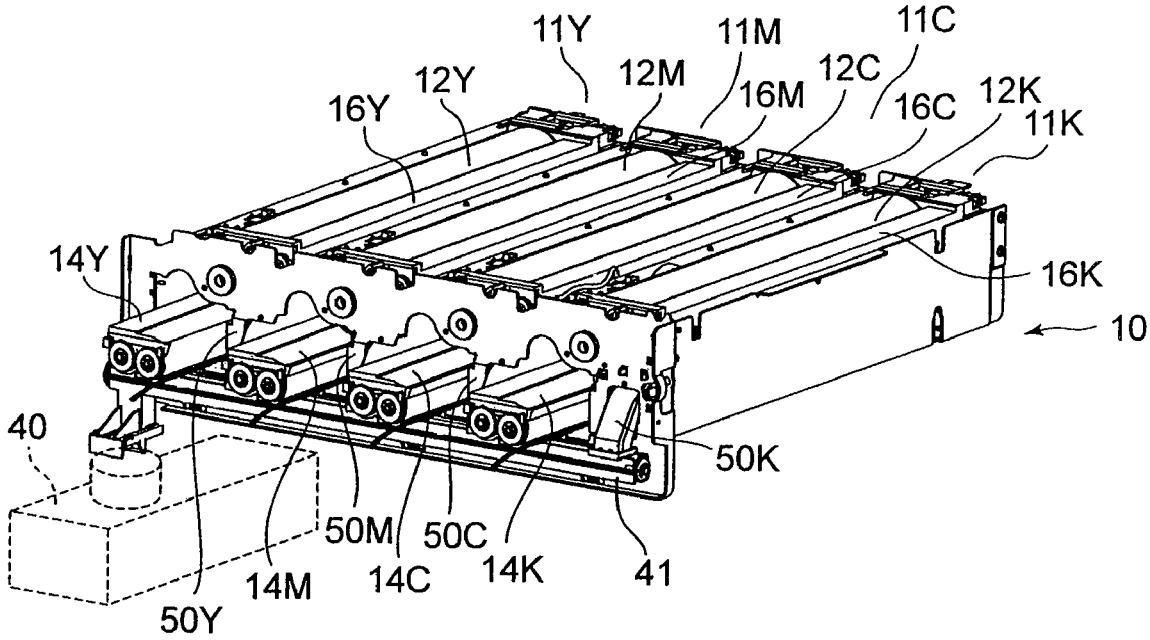
FIG. 1 is a schematic perspective view showing an electrophotographic process unit according to a first embodiment of the invention.

Hereinafter, a first embodiment of the invention will be described in detail with reference to the attached drawings. FIG. 1 shows a schematic perspective view of an electrophotographic process unit (hereinafter abbreviated as EPU) 10, which is an image forming unit of a four-drum tandem color image forming apparatus as an image forming apparatus according to an embodiment of the invention. The EPU 10 has four process stations 11Y, 11M, 11C and 11K of yellow (Y), magenta (M), cyan (C) and black (K), respectively, arranged parallel to each other along the lower side of a belt unit 20 shown in FIG. 2. On the front side of the EPU 10, a horizontal feeding unit 41 as a feeding unit is provided which feeds disposed toner to one side of the EPU 10 in order to collect the disposed toner collected from the four process stations 11Y, 11M, 11C and 11K into a disposed toner box 40 as a collection container. The disposed toner box 40 and the horizontal feeding unit 41 form a collecting unit.

Figure 2:
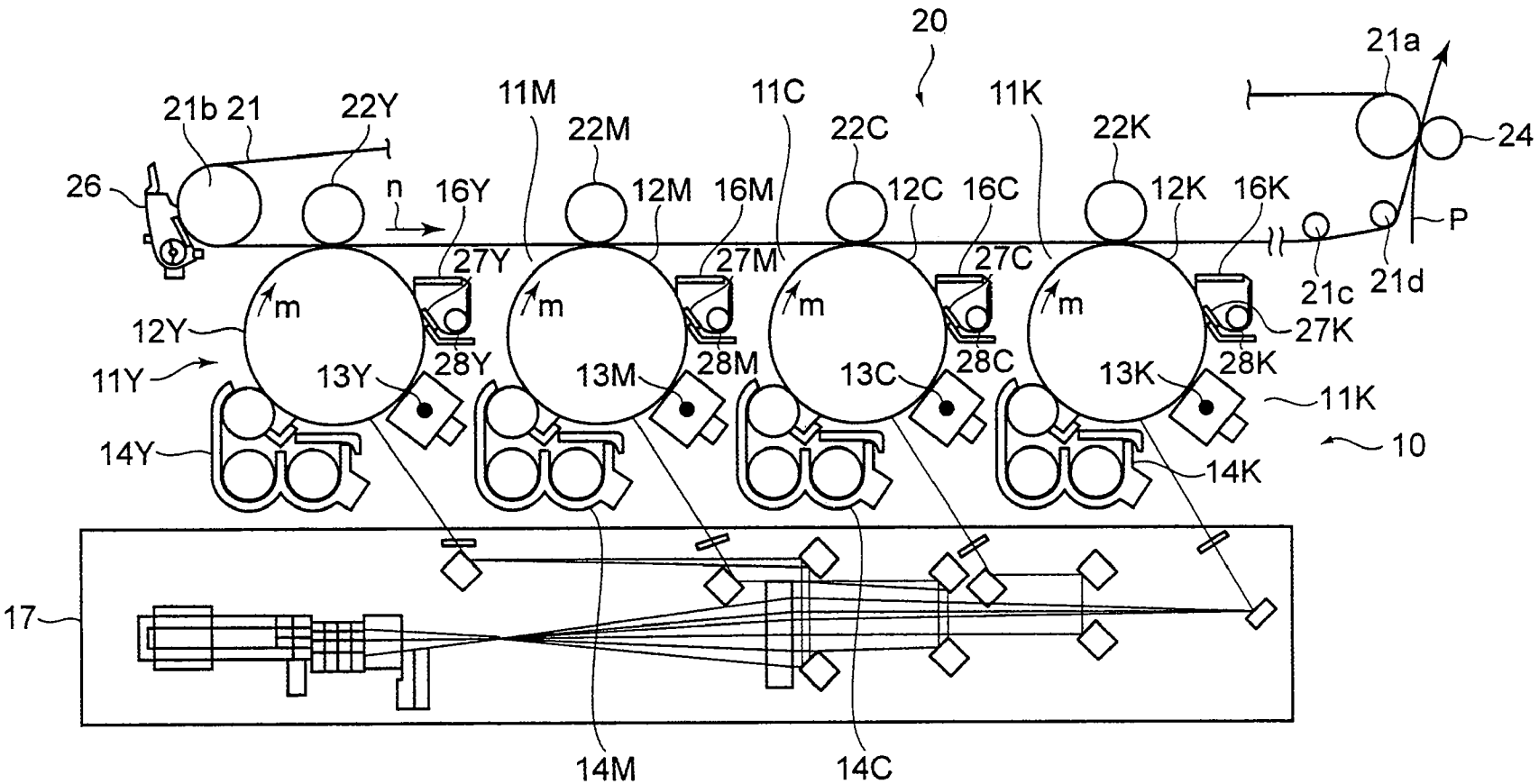
FIG. 2 is a schematic configuration view showing the electrophotographic process unit and a belt unit according to the first embodiment of the invention.
Figure 3:
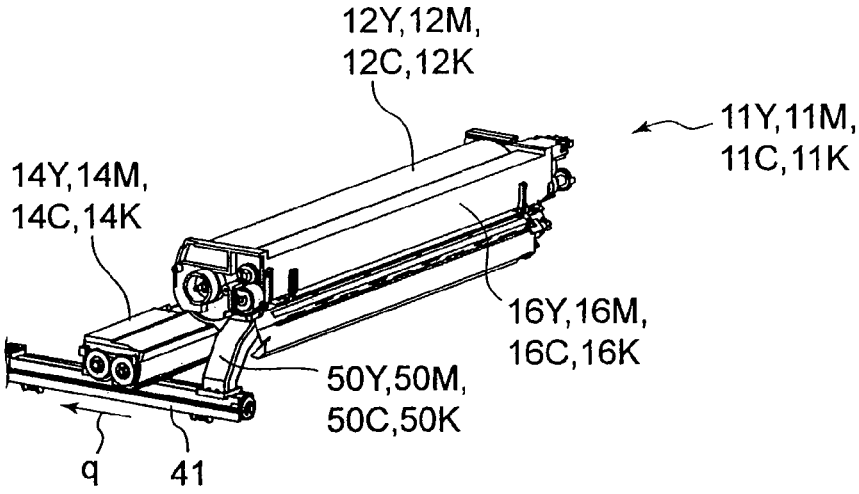
FIG. 3 is a schematic perspective view showing a process station according to the first embodiment of the invention.
Figure 4:
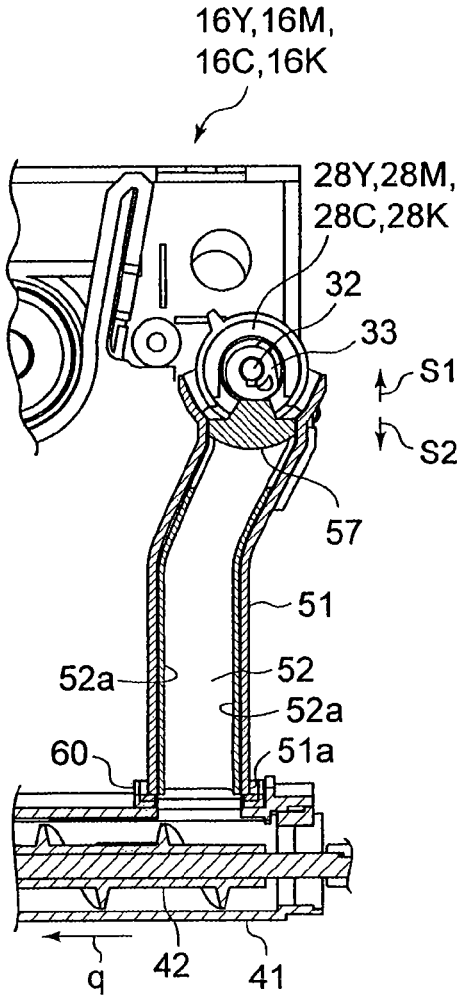
FIG. 4 is a schematic explanatory view showing a part of a disposed toner collecting device according to the first embodiment of the invention, as viewed from the front side.

The EPU 10 has the four process stations 11Y, 11M, 11C and 11K of yellow (Y), magenta (M), cyan (C) and black (K), respectively, arranged parallel to each other along the lower side of an intermediate transfer belt 21, as shown in FIG. 2. In the process stations 11Y, 11M, 11C and 11K, chargers 13Y, 13M, 13C and 13K, developing devices 14Y, 14M, 14C and 14K and photoconductor cleaners 16Y, 16M, 16C and 16K as cleaning units which form a first process mechanism, are respectively arranged around photoconductive drums 12Y, 12M, 12C and 12K, each of which is an image carrier rotating in the direction of an arrow m.

Between the chargers 13Y, 13M, 13C and 13K and the developing devices 14Y, 14M, 14C and 14K around the photoconductive drums 12Y, 12M, 12C and 12K, laser beams are cast from a laser exposure device 17 and an electrostatic latent image is formed on each of the photoconductive drums 12Y, 12M, 12C and 12K. The developing devices 14Y, 14M, 14C and 14K have a two-component developer containing yellow (Y), magenta (M), cyan (C) and black (K) toner, respectively, and a carrier, and supply the toner to the electrostatic latent images on the photoconductive drums 12Y, 12M, 12C and 12K respectively.

The intermediate transfer belt 21 is laid over a backup roller 21*a*, a driven roller 21*b* and tension rollers 21*c* and 21*d* and is driven to turn in the direction of an arrow n. Primary transfer rollers 22Y, 22M, 22C and 22K for performing primary transfer of the toner images on the photoconductive drums 12Y, 12M, 12C and 12K to the intermediate transfer belt 21 respectively are arranged at primary transfer positions on the intermediate transfer belt 21 facing the photoconductive drums 12Y, 12M, 12C and 12K.

A secondary transfer roller 24 is arranged at a position facing the backup roller 21*a* on the periphery of the intermediate transfer belt 21. A predetermined secondary transfer bias is applied to the backup roller 21*a*. A belt cleaner 26 is provided downstream of the secondary transfer roller 24, on the intermediate transfer belt 21.

The photoconductor cleaners 16Y, 16M, 16C and 16K have cleaning blades 27Y, 27M, 27C and 27K, respectively, for removing residual toner on the photoconductive drums 12Y, 12M, 12C and 12K after primary transfer of the toner images to the intermediate transfer belt 21. The photoconductor cleaners 16Y, 16M, 16C and 16K have disposed toner collection augers 28Y, 28M, 28C and 28K, respectively, which feed disposed toner removed form the photoconductive drums 12Y, 12M, 12C and 12K toward the front side of the EPU 10.

Now, disposed toner collecting devices 50Y, 50M, 50C and 50K that collect disposed toner removed by the photoconductor cleaners 16Y, 16M, 16C and 16K respectively will be described in detail with reference to FIG. 3 to FIG. 6. Since the disposed toner collecting devices 50Y, 50M, 50C and 50K have the same structure, common reference numerals are used in the description. The disposed toner collecting devices 50Y, 50M, 50C and 50K are provided on the front side of the EPU 10, as shown in FIG. 1.

The photoconductor cleaners 16Y, 16M, 16C and 16K remove residual toner on the photoconductive drums 12Y, 12M, 12C and 12K respectively by using the cleaning blades 27Y, 27M, 27C and 27K after primary transfer of toner images to the intermediate transfer belt 21. Each removed disposed toner is fed to disposed toner discharge units 30Y, 30M, 30C and 30K on the front side of the EPU 10 by the disposed toner collection augers 28Y, 28M, 28C and 28K respectively. On the front side of the EPU 10, a cam 33 is attached to a shaft 32 of each of the disposed toner collection augers 28Y, 28M, 28C and 28K. The shafts 32 of the disposed toner collection augers 28Y, 28M, 28C and 28K are made of steel. Spiral parts of the disposed toner collection augers 28Y, 28M, 28C and 28K are made of thermoplastic resin such as polystyrene (PS) or acrylonitrile-butadiene-styrene (ABS). In the disposed toner collection augers, the shaft and spiral part may be formed as an integrated unit of thermoplastic resin, or a metal spiral part may be welded to the steel shaft.

Each of the disposed toner collecting devices 50Y, 50M, 50C and 50K has a disposed toner duct 51 as a guide connected to the disposed toner discharge units 30Y, 30M, 30C and 30K. By using gravity, the disposed toner duct 51 causes disposed toner to the disposed toner discharge units 30Y, 30M, 30C and 30K to fall and be fed. The lower end of the disposed toner duct 51 is connected to the horizontal feeding unit 41. The horizontal feeding unit 41 has a horizontal feeding auger 42 that feeds the disposed toner falling from the disposed toner duct 51, into the direction of an arrow q. The disposed toner fed to the horizontal feeding auger 42 is collected into the disposed toner box 40. The lower end 51*a* of the disposed toner duct 51 and the horizontal feeding unit 41 are connected via an elastic first seal member 60. Thus, the connecting part between the lower end 51*a* of the disposed toner duct 51 and the horizontal feeding unit 41 is sealed.

In the disposed toner duct 51, a sliding plate 52 is provided, which is a feeding assistance unit and a sliding member. The sliding plate 52 is made of polyacetal having high slidability. Both lateral parts 52*a* of the sliding plate 52 contact the inner wall of the disposed toner duct 51. The sliding plate 52 gives oscillation to the disposed toner and thus promotes falling and feeding of the disposed toner. The sliding plate 52 is turnable about an attachment part 53 with the disposed toner duct 51, as the fulcrum of its turn. The sliding plate 52 is constantly energized in the direction of an arrow r by a coil spring 58 as a first energizing member. A bracket 56 is attached to an upper part of the sliding plate 52. At a free end of the bracket 56, a cam follower 57 is provided, which is a transmitting unit. The cam follower 57 is constantly in contact with the cam 33 attached to the shaft 32 of each of the collection augers 28Y, 28M, 28C and 28K by energizing force of the coil spring 58. The cam follower 57 transmits driving of the rotating cam 33 to the sliding plate 52. Both lateral parts 52*a* of the sliding plate 52, the bracket 56 and the cam follower 57 are integrally formed.

Next, operations will be described. When image formation is started and image information is inputted from a scanner, personal computer terminal or the like, the four process stations 11Y, 11M, 11C and 11K of the EPU 10 form toner images. The photoconductive drums 12Y, 12M, 12C and 12K are rotated in the direction of the arrow m and uniformly charged by the chargers 13Y, 13M, 13C and 13K, respectively. Then, the photoconductive drums 12Y, 12M, 12C and 12K are irradiated with a laser beam corresponding to image information of the corresponding color by the laser exposure device 17 and thus have electrostatic latent images formed thereon. Then, the photoconductive drums 12Y, 12M, 12C and 12K have toner images formed thereon by the developing devices 14Y, 14M, 14C and 14K respectively.

The toner images on the photoconductive drums 12Y, 12M, 12C and 12K are transferred as primary transfer to the intermediate transfer belt 21 turned in the direction of the arrow n, by the primary transfer rollers 22Y, 22M, 22C and 22K which are applied each primary transfer bias. As the toner images on the photoconductive drums 12Y, 12M, 12C and 12K are transferred, a full-color toner image is formed on the intermediate transfer belt 21.

Next, the full-color toner image on the intermediate transfer belt 21 is collectively transferred to a paper sheet P as secondary transfer by the secondary transfer roller 24. After that, the paper sheet P goes through fixation and the toner image is completed. The intermediate transfer belt 21 has the residual toner, which is cleaned by the belt cleaner 26 after the end of secondary transfer. The photoconductive drums 12Y, 12M, 12C and 12K have the residual toner, which is removed by the photoconductor cleaners 16Y, 16M, 16C and 16K after primary transfer of toner images to the intermediate transfer belt 21, and then stand by for next image formation.

Now, collection of disposed toner will be described in detail. The photoconductor cleaners 16Y, 16M, 16C and 16K remove toner remaining on the photoconductive drums 12Y, 12M, 12C and 12K, by using the cleaning blades 27Y, 27M, 27C and 27K respectively. The disposed toner collection augers 28Y, 28M, 28C and 28K feed the removed disposed toner toward the front side of the EPU 10. The disposed toner reaching the disposed toner discharge units 30Y, 30M, 30C and 30K on the front side of the EPU 10 is guided by the disposed toner ducts 51 and, by gravity, falls to be fed in the direction of the horizontal feeding unit 41.

While the disposed toner collection augers 28Y, 28M, 28C and 28K are rotating to feed the disposed toner to the front side of the EPU 10, the sliding plate 52 oscillates in the disposed toner duct 51. The sliding plate 52 oscillates by reciprocating and turning between the position indicated by a solid line and the position indicated by a dotted line in FIG. 5. The oscillation of the sliding plate 52 promotes falling and feeding of the disposed toner.

Figure 5:
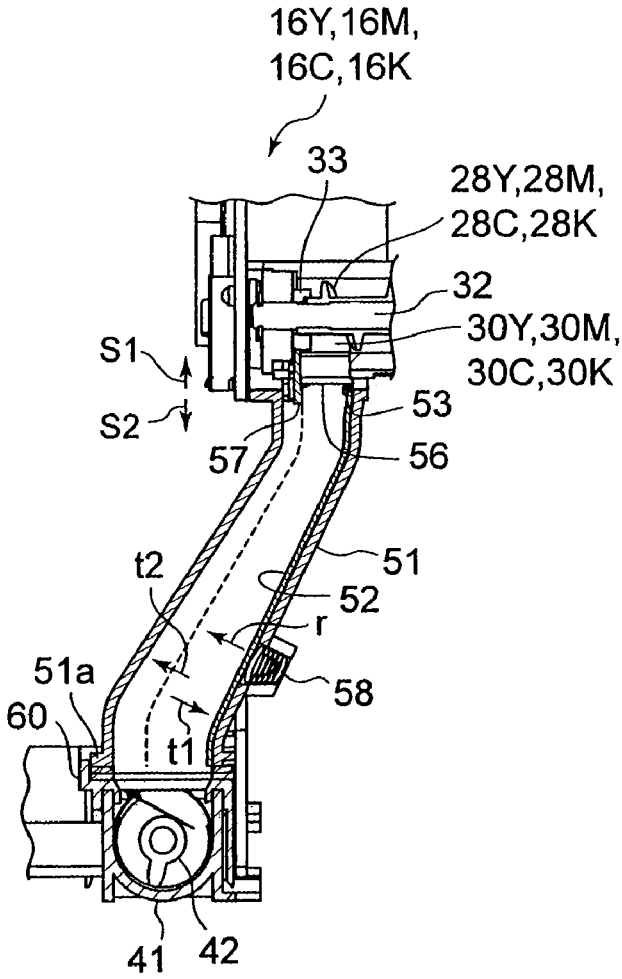
FIG. 5 is a schematic explanatory view showing a part of the disposed toner collecting device according to the first embodiment of the invention, as viewed from the lateral side.
Figure 6:
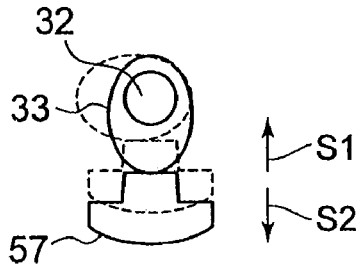
FIG. 6 is a schematic explanatory view showing the movement of a cam and a cam follower according to the first embodiment of the invention.

When disposed toner collection augers 28Y, 28M, 28C and 28K rotate, the rotation of the cam 33 attached to the shaft 32 causes the cam follower 57 to oscillate in the direction of an arrow s1 and in the direction of an arrow s2 in FIG. 5. When the cam 33 is situated at the position indicated by a solid line in FIG. 6 and pushes down the cam follower 57 into the direction of an arrow S2, the sliding plate 52 turns in the direction of an arrow t1 against the energizing force in the direction of the arrow r by the coil spring 58. When the cam 33 turns to the position indicated by a dotted line in FIG. 6, the cam follower 57 is pushed up into the direction of an arrow S1 by the energizing force in the direction of the arrow r by the coil spring 58. Along with this, the sliding plate 52 turns in the direction of an arrow t2.

By the reciprocating turn of the sliding plate 52, the disposed toner caused to fall and thus fed through the disposed toner duct 51 is oscillated. Falling and feeding of the disposed toner is thus promoted without adherence of the disposed toner to the inner wall of the disposed toner duct 51. When the sliding plate 52 oscillates, both lateral parts 52*a* of the sliding plate 52 slide to remove the disposed toner adhering to the inner wall of the disposed toner duct 51, and thus allows the disposed toner to fall and be fed.

The horizontal feeding unit 41 feeds the disposed toner falling and fed from the disposed toner ducts 51 of the process stations 11Y, 11M, 11C and 11K, into the direction of the arrow q by the horizontal feeding auger 42 and thereby collects the disposed toner into the disposed toner box 40.

According to the first embodiment, the sliding plate 52 sliding in contact with the inner wall of the disposed toner duct 51 is oscillated by using the rotation of the disposed toner collection augers 28Y, 28M, 28C and 28K. This causes the disposed toner falling and fed through the disposed toner duct 51 to oscillate, and prevents the disposed toner from being accumulated in the disposed toner duct 51. Consequently, falling and feeding of the disposed toner through the disposed toner duct 51 is promoted. Moreover, the disposed toner adhering to the inner wall of the disposed toner duct 51 is removed by both lateral parts 52*a* of the sliding plate 52 that slide in contact with the inner wall, and then falls to be fed. Consequently, accumulation of the disposed toner between the sliding plate 52 and the disposed toner duct 51 is prevented and immobility of the sliding plate 52 does not occur. Thus, the disposed toner can be smoothly collected into the disposed toner box 40.

Next, a second embodiment of the invention will be described. In the second embodiment, falling and feeding of disposed toner in the disposed toner duct is promoted without using the sliding plate of the first embodiment. The other parts of the second embodiment are similar to those of the first embodiment. Therefore, in the second embodiment, the same configuration as the configuration of the first embodiment is denoted by the same reference numerals and will not be described further in detail.

Figure 7:
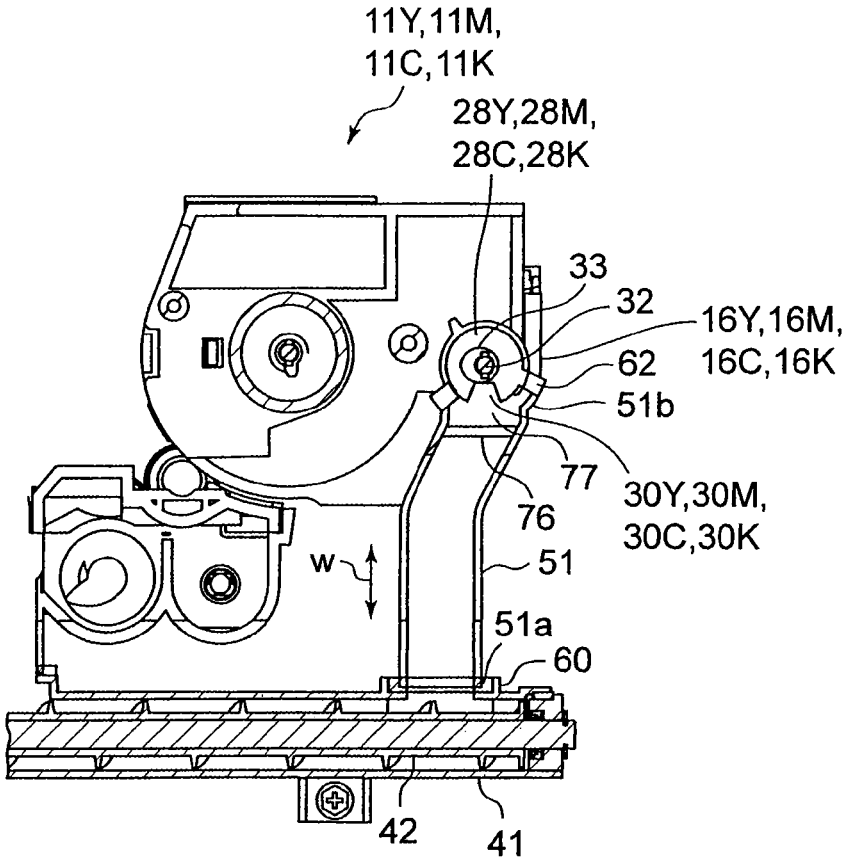
FIG. 7 is a schematic explanatory view showing a part of a disposed toner collecting device according to a second embodiment of the invention, as viewed from the front side.
Figure 8:
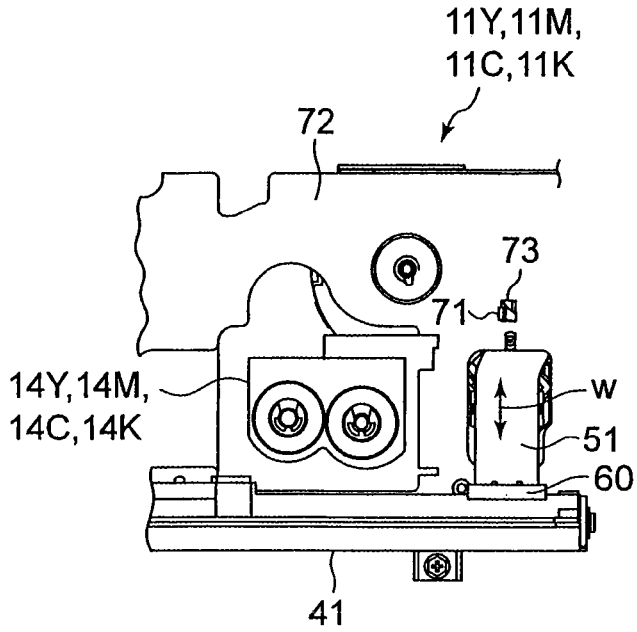
FIG. 8 is a front view showing a part of an electrophotographic process unit according to the second embodiment of the invention.
Figure 9:
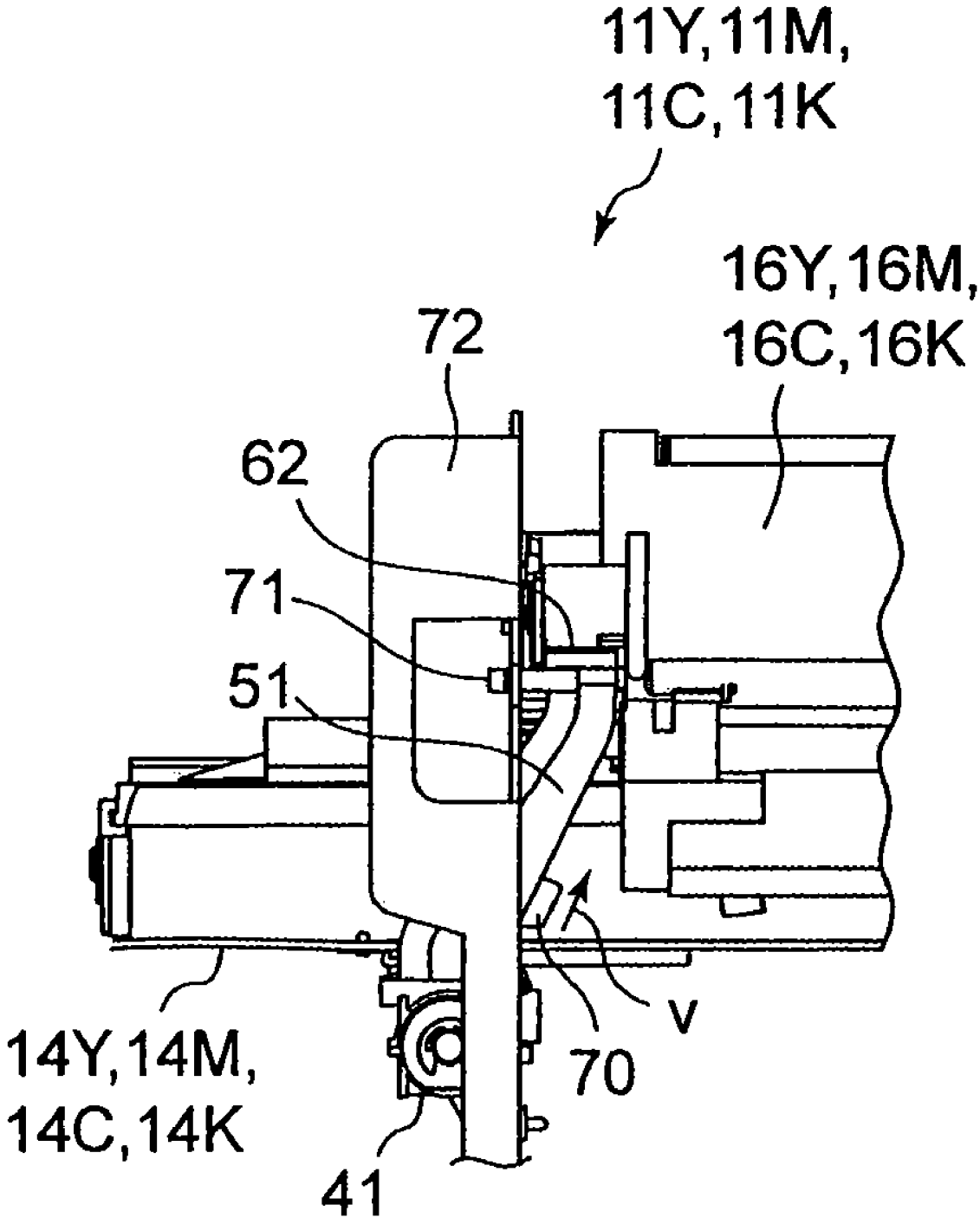
FIG. 9 is a side view showing a part of the electrophotographic process unit according to the second embodiment of the invention.

In the second embodiment, the disposed toner duct 51 itself is oscillated. As shown in FIG. 7, an upper end 51*b* of the disposed toner duct 51 and the disposed toner discharge units 30Y, 30M, 30C and 30K of the photoconductor cleaners 16Y, 16M, 16C and 16K are connected via an elastic second seal member 62 respectively. The lower end 51*a* of the disposed toner duct 51 is connected to the horizontal feeding unit 41 via the elastic first seal member 60. Therefore, the disposed toner duct 51 is supported by the second seal member 62 and the first seal member 60 so as to be able to fluctuate between the photoconductor cleaners 16Y, 16M, 16C and 16K and the horizontal feeding unit 41.

An energizing force by, for example, a second coil spring 70 as a second energizing member acts on the outer wall of the disposed toner duct 51. The disposed toner duct 51 is constantly energized into the direction of an arrow v by the second coil spring 70. Meanwhile, a control pin 71 is formed on the front side of the disposed toner duct 51. The control pin 71 is fitted in a guide slit 73 formed on a front cover 72 of the EPU 10 and controls the direction of fluctuation of the disposed toner duct 51.

A stay 76 as a fluctuating part is provided within the disposed toner duct 51. The second coil spring 70, the control pin 71 and the stay 76 form a feeding assistance unit. A second cam follower 77 as a transmitting unit is attached to the stay 76. Receiving the energizing force of the second coil spring 70, the second cam follower 77 is constantly in contact with the cam 33 attached to the shaft 32 of each of the collection augers 28Y, 28M, 28C and 28K. The second cam follower 77 transmits driving of the rotating cam 33 to the disposed toner duct 51 via the stay 76.

While the disposed toner collection augers 28Y, 28M, 28C and 28K are rotating to feed disposed toner toward the front side of the EPU 10, the disposed toner duct 51 fluctuates between the first seal member 60 and the second seal member 62. This promotes falling and feeding of the disposed toner.

As the cam 33 attached to the shaft 32 rotates according to the rotation of the disposed toner collection augers 28Y, 28M, 28C and 28K, the second cam follower 77 is caused oscillate in the direction of an arrow w in FIG. 7 by the energizing force of the cam 33 and the energizing force of the second coil spring 70. Thus, the disposed toner duct 51 is oscillated in the direction of the arrow w via the stay 76. When oscillating, the disposed toner duct 51 has the direction of its oscillation regulated by the control pin 71 and the guide slit 73. As the disposed toner duct 51 oscillates, the disposed toner falling and fed through the disposed toner duct 51 is oscillated. Falling and feeding of the disposed toner is promoted without adherence of the disposed toner to the inner wall of the disposed toner duct 51.

According to the second embodiment, the disposed toner duct 51 is oscillated by using the rotation of the disposed toner collection augers 28Y, 28M, 28C and 28K. Thus, the disposed toner falling and fed through the disposed toner duct 51 is oscillated and the disposed toner is prevented from adhering to the inner side of the disposed toner duct 51. Consequently, falling and feeding of the disposed toner through the disposed toner duct 51 is promoted and the disposed toner can be smoothly collected into the disposed toner box 40.

The invention is not limited to the above embodiments. Various changes and modifications can be made without departing from the scope of the invention. For example, the guide can be arbitrarily shaped in accordance with its arrangement position and so on as long as the guide can allow falling and feeding of the disposed toner. The cam need not be attached to the shafts of the disposed toner collection augers as long as the cam is driven by the driving on the image forming unit side. Also, the shape of the cam may be arbitrary.

What is claimed is:

1. A disposed toner collecting device comprising:

a guide that causes disposed toner discharged from a disposed toner discharge unit of an image forming unit to fall and to be fed;

a feeding assistance unit configured to provide oscillation to the disposed toner in the guide, the feeding assistance unit including a sliding plate to turn the guide and a spring that turns the sliding plate in a first direction;

a cam driven by a driving unit in the image forming unit;

a transmitting unit configured to transmit a driving force of the cam to the feeding assistance unit to turn the sliding plate in a direction opposing the first direction in accordance with a shape of the cam; and a collecting unit connected to a lower end of the guide and configured to collect the disposed toner.

2. The device according to claim 1, wherein the collecting unit has a feeding unit connected to the guide and configured to feed the disposed toner falling from the guide in a predetermined direction, and a collection container that houses the disposed toner fed by the feeding unit.

3. The device according to claim 2, further comprising an elastic first seal member that seals a connection part between the guide and the feeding unit.

4. The device according to claim 3, further comprising an elastic second seal member that seals a connection part between the guide and the disposed toner discharge unit.

5. The device according to claim 1, wherein plural units of the guide are provided, and the plural guides cause disposed toner discharged from plural disposed toner discharge units of the image forming unit, to fall and be fed, respectively.

6. The device according to claim 5, wherein the collecting unit has a feeding unit connected to the plural guides and configured to feed the disposed toner falling from the plural guides in a predetermined direction, and a collection container that houses the disposed toner fed by the feeding unit.

7. The device according to claim 1, wherein the sliding plate turns about an attachment part with the guide serving as a fulcrum of the turn, and the attachment part is integrated with the transmitting unit.

8. The device according to claim 1, wherein the sliding plate includes two lateral parts that slide in contact with inner walls of the guide.

9. An image forming apparatus comprising:

an image forming unit having an image carrier, and a cleaning unit configured to remove toner from the image carrier and to feed the removed disposed toner to a disposed toner discharge unit;

a guide that causes the disposed toner discharged from the disposed toner discharge unit, to fall in a predetermined direction;

a feeding assistance unit configured to provide oscillation to the disposed toner in the guide, the feeding assistance unit including a sliding plate to turn the guide and a spring that turns the sliding plate in a first direction;

a cam driven by a driving unit in the cleaning unit;

a transmitting unit configured to transmit a driving force of the cam to the feeding assistance unit to turn the sliding plate in a direction opposing the first direction in accordance with a shape of the cam; and a collecting unit connected to a lower end of the guide and configured to collect the disposed toner.

10. The apparatus according to claim 9, wherein the cleaning unit has a disposed toner feeding auger that feeds the disposed toner to the disposed toner discharge unit, and the cam is coaxially driven with a shaft of the disposed toner feeding auger.

11. The apparatus according to claim 9, wherein the image forming unit has plural image carriers and plural cleaning units for the plural image carriers, respectively, and plural units of the guide are provided so that disposed toner discharged from disposed toner discharge units of the plural cleaning units are caused to fall in a predetermined direction, respectively.

12. The apparatus according to claim 11, wherein the collecting unit has a feeding unit connected to the plural guides and configured to feed the disposed toner falling from the plural guides in a predetermined direction, and a collection container that houses the disposed toner fed by the feeding unit.

13. The device according to claim 9, wherein the sliding plate turns about an attachment part with the guide serving as a fulcrum of the turn, and the attachment part is integrated with the transmitting unit.

14. The device according to claim 9, wherein the sliding plate includes two lateral parts that slide in contact with inner walls of the guide.

15. A disposed toner collecting method comprising:

receiving disposed toner discharged from a disposed toner discharge unit of an image forming unit, with a guide, and causing the disposed toner to fall down;

oscillating the disposed toner in the guide by turning a sliding plate in a first direction by a spring force and turning the sliding plate in a direction opposite the first direction by a pressing force; and collecting the disposed toner falling in the guide, below the guide.

16. The device according to claim 15, wherein the sliding plate turns about an attachment part with the guide serving as a fulcrum of the turn.

17. The method according to claim 15, wherein the sliding plate slides two lateral parts in contact with the inner walls of the guide.

* * * * *